US009969527B2

(12) United States Patent
Smith et al.

(10) Patent No.: US 9,969,527 B2
(45) Date of Patent: May 15, 2018

(54) MODULAR VACUUM CHAMBER SYSTEM

(71) Applicant: Ideal Vacuum Products LLC, Albuquerque, NM (US)

(72) Inventors: Tony C. Smith, Albuquerque, NM (US); Richard D Holets, Albuquerque, NM (US)

(73) Assignee: Ideal Vacuum Products LLC, Albuquerque, NM (US)

( * ) Notice: Subject to any disclaimer, the term of this patent is extended or adjusted under 35 U.S.C. 154(b) by 0 days. days.

(21) Appl. No.: 15/204,271

(22) Filed: Jul. 7, 2016

(65) Prior Publication Data

US 2017/0107014 A1 Apr. 20, 2017

Related U.S. Application Data

(60) Provisional application No. 62/243,249, filed on Oct. 19, 2015.

(51) Int. Cl.
*B65D 21/00* (2006.01)
*B65D 21/02* (2006.01)

(52) U.S. Cl.
CPC ..... *B65D 21/0201* (2013.01)

(58) Field of Classification Search
USPC ..... 220/668
See application file for complete search history.

(56) References Cited

U.S. PATENT DOCUMENTS 3,261,493 A * 7/1966 Smith ..... B65D 9/12 217/65
3,509,904 A * 5/1970 Olson ..... F15B 13/0817 137/269
3,992,840 A * 11/1976 Badat ..... B65D 7/12 52/285.2
4,712,578 A * 12/1987 White ..... F16L 41/03 137/269
4,782,852 A * 11/1988 Legris ..... F16L 37/252 137/269
6,527,302 B1 * 3/2003 Gault ..... F16L 41/03 174/50
8,690,005 B2 * 4/2014 Baltussen ..... H01J 37/16 220/681

* cited by examiner

*Primary Examiner* — John Fox
(74) *Attorney, Agent, or Firm* — V Gerald Grafe

(57) ABSTRACT

A modular vacuum chamber system provides for tapered surfaces and resilient sealing members, wherein the tapered surfaces are protected from undesired contact with work surfaces, and provide for vacuum-tight engagement of various modules. Modules can include chamber modules, defining shapes for a resultant vacuum chamber. Modules can comprise connecting modules, configured to sealingly engage two chamber modules and form a larger vacuum chamber than either module alone. Modules can comprise wall plate modules, configured to sealingly engage a chamber module and form a surface of a vacuum chamber. Wall plate modules can comprise solid plates, optically transparent plates, and plates accommodating ports for communication between the vacuum chamber and the environment outside the vacuum chamber.

13 Claims, 22 Drawing Sheets

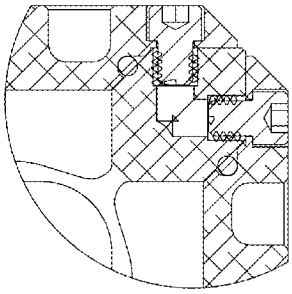
DETAIL D
SCALE 1 : 1
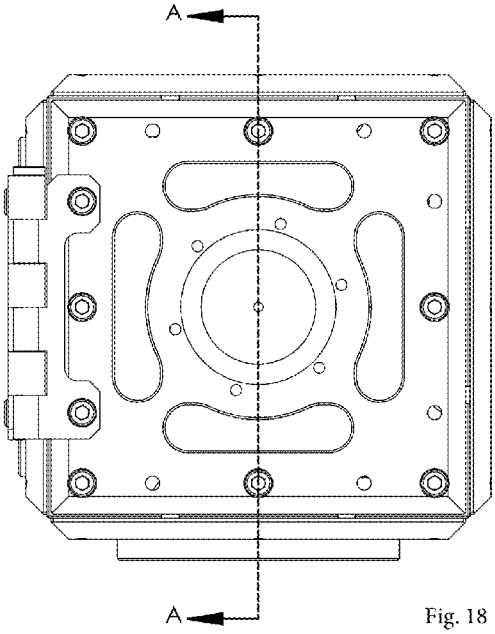
Fig. 18
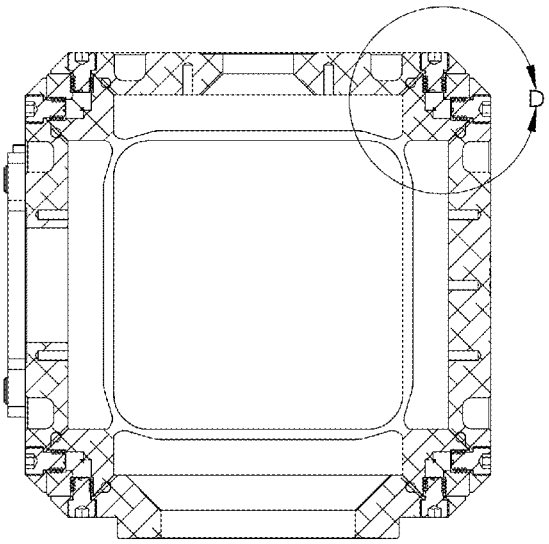
SECTION A-A

MODULAR VACUUM CHAMBER SYSTEM

FIELD OF THE INVENTION

This invention relates to the vacuum chamber systems, and more specifically to methods and apparatuses suitable for vacuum chamber systems that can be constructed in a modular fashion, suitable for convenient customization and reconfiguration.

BRIEF DESCRIPTION OF THE DRAWINGS

Various aspects and attendant advantages of one or more exemplary embodiments and modifications thereto will become more readily appreciated as the same becomes better understood by reference to the following detailed description, when taken in conjunction with the accompanying drawings.

FIG. 18 comprises schematic illustrations of an assembled vacuum chamber according to the present invention.

Some of the figures include elements showing "Varian", "Ideal", or "Ideal Vacuum Products", which are trademarks of their respective owners.

DISCLOSURE OF INVENTION

Embodiments of the present invention provide a new style vacuum chamber that includes a new sealing feature. The new sealing feature allows an o-ring sealed chamber that can achieve "High Vacuum" (down to $1\times10^{-7}$ torr). Embodiments of the invention can include modular frames (chamber modules), which can comprise cubes or other shapes that can be linked together to create chamber systems having a wide variety of shapes and sizes. Embodiments of the invention can provide interchangeable wall plates with varying designs, which can be used to create many different system configurations. The wall plates can incorporate standard optical table threads for system and accessory mounting.

The new sealing feature can comprise a tapered (e.g., 45°, though other angles can also be suitable) sealing surface with captive o-rings. This configuration facilitates simple plate installation and both frame and cube can be set on work surfaces without damaging contact to critical sealing surfaces.

Figure 1:
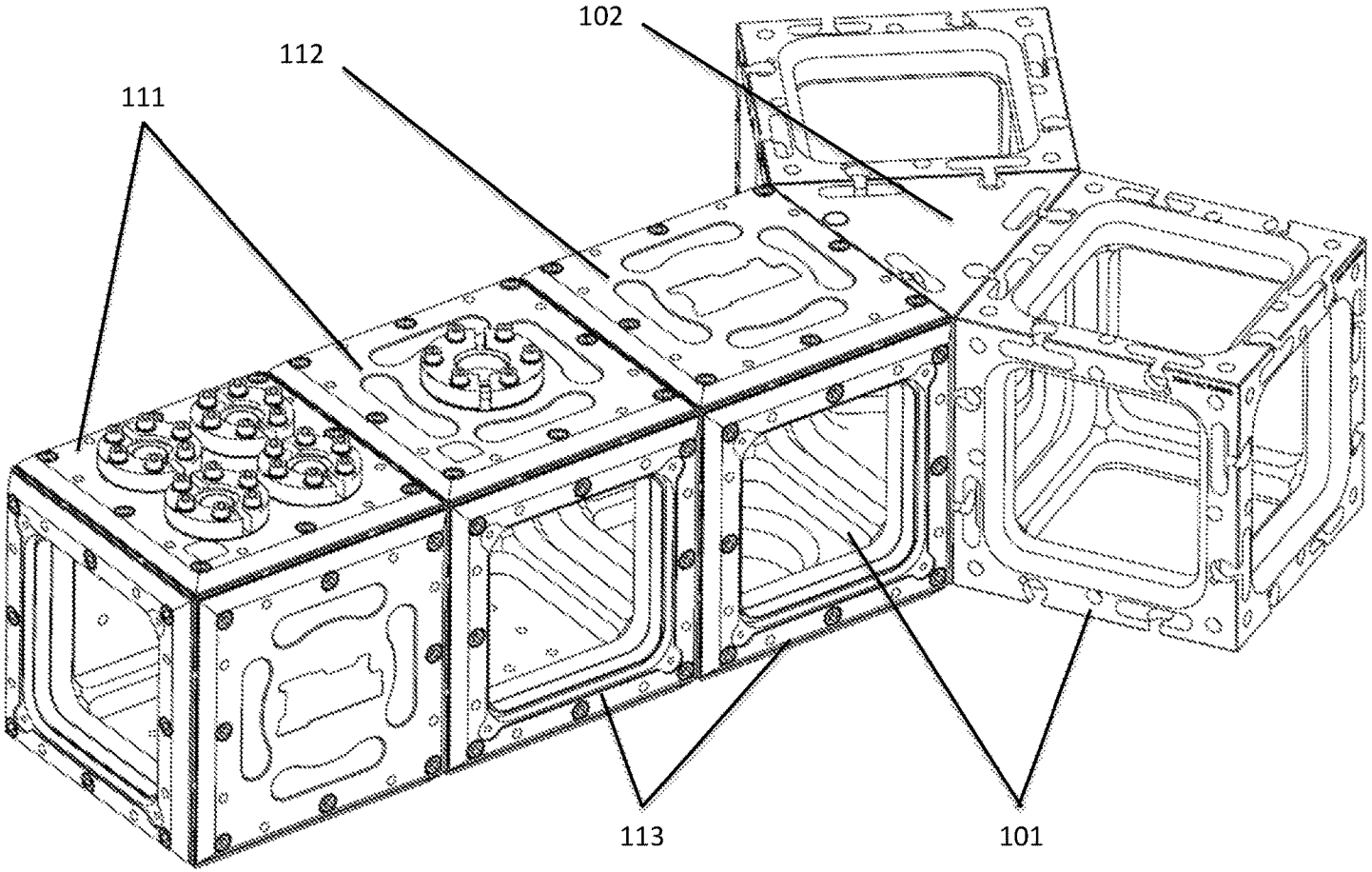
FIG. 1 is a schematic illustration of a vacuum chamber system comprising a plurality of modules according to the present invention.

FIG. 1 is a schematic illustration of a vacuum chamber system comprising a plurality of modules according to the present invention. The system comprises a plurality of chamber modules 101, 102. Modules 101 are roughly cube-shaped, although other configurations can be suitable (e.g., other cuboids and rectangular prisms). The system further comprises a plurality of wall plate modules 111, 112, 113. Wall plate module 112 comprises a solid wall, e.g., metal, that seals the chamber to both air and light. Wall plates 111 provide one or more ports that accommodate connections from outside the vacuum chamber into the chamber. Wall plates 113 provide a solid, but optically transparent, wall.

Figure 2:
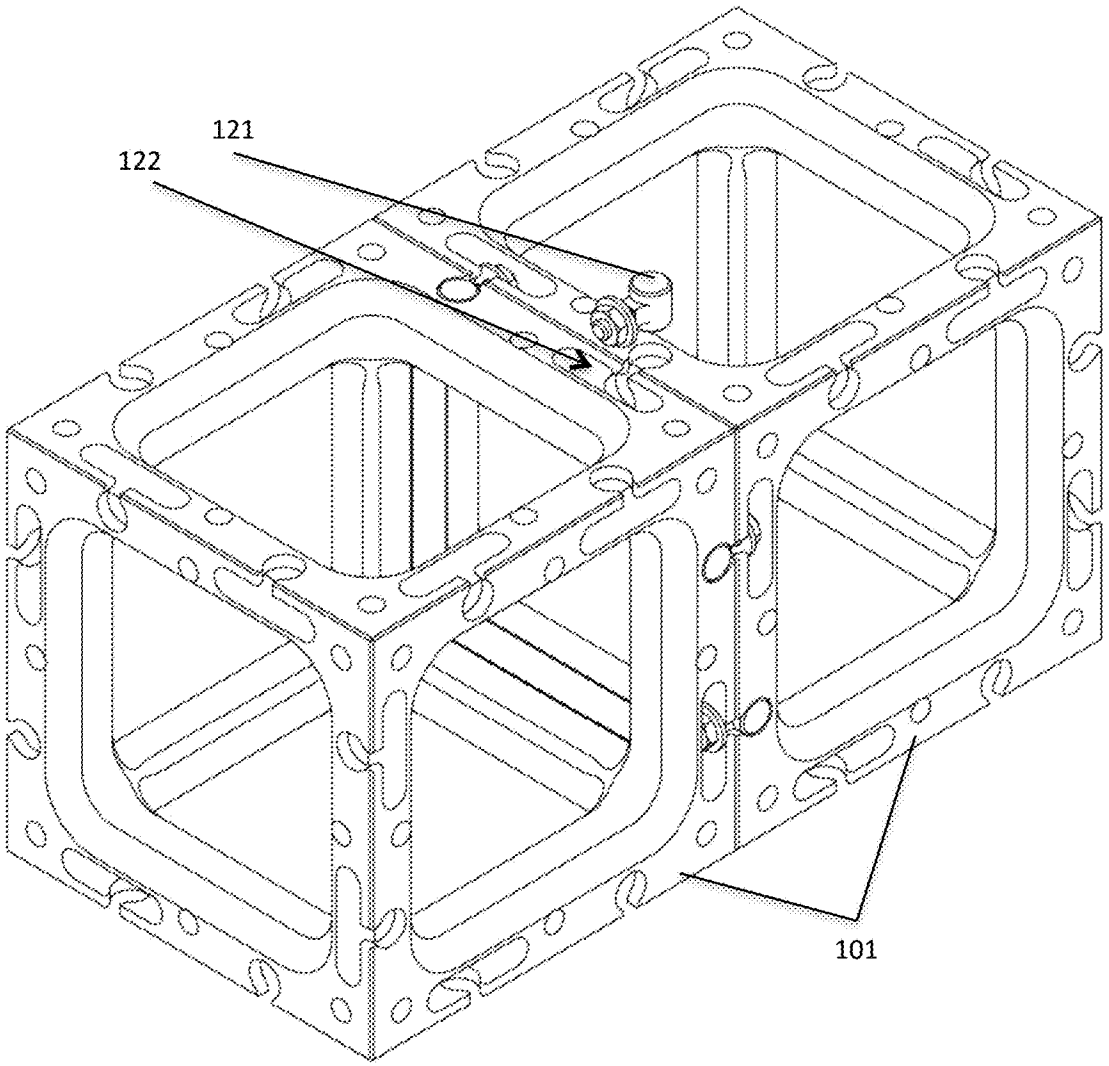
FIG. 2 is a schematic illustration of a vacuum chamber comprising two chamber modules according to the present invention.

FIG. 2 is a schematic illustration of a vacuum chamber system comprising two chamber modules according to the present invention. The system comprises two chamber modules 101. The chamber modules have mounting features, such as openings 121 that are configured to accept a bolt assembly 121. In use, a plurality of bolt assemblies mount with the openings and when tightened, bring the two chamber modules into close alignment such that the sealing feature (described below) preserves the integrity of the vacuum chamber.

Figure 3:
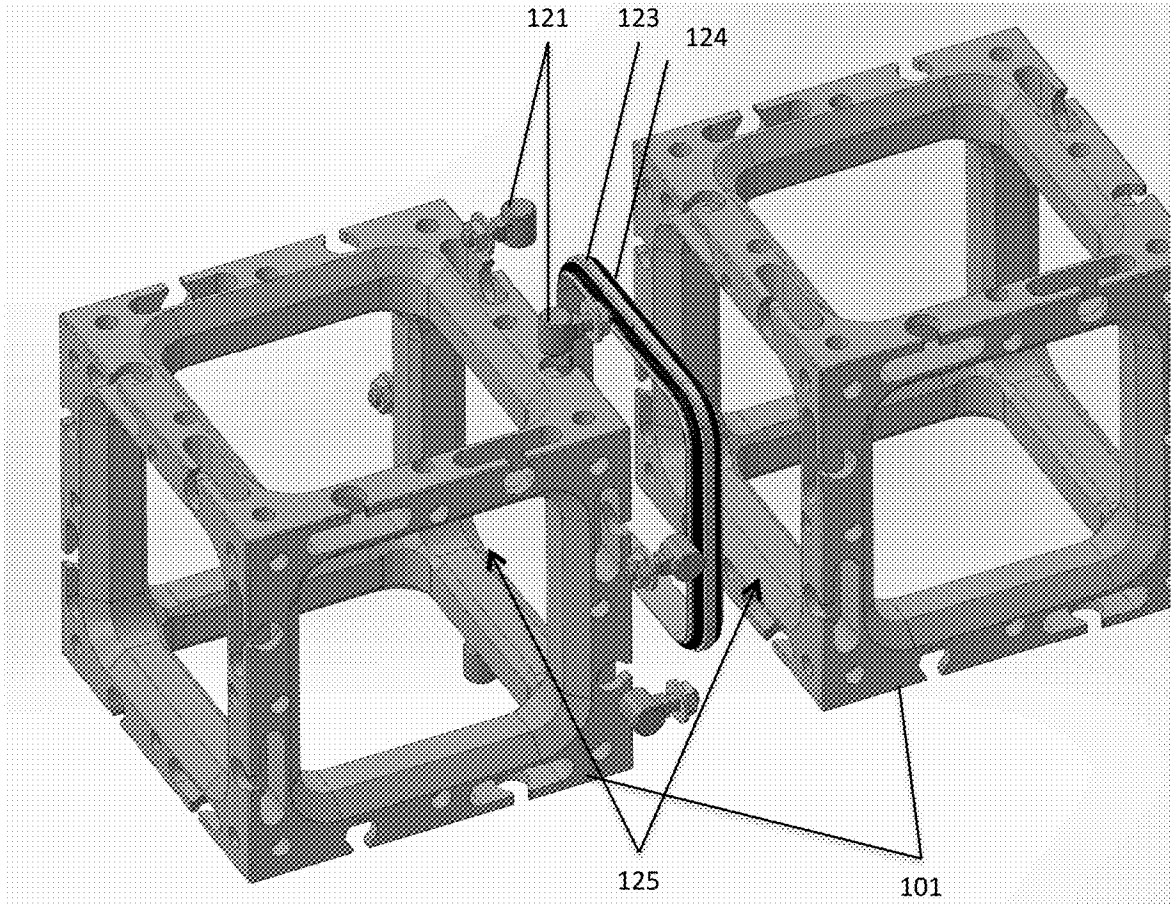
FIG. 3 is a schematic illustration of a vacuum chamber as in FIG. 2, partially disassembled.

FIG. 3 is a schematic illustration of a vacuum chamber as in FIG. 2, partially disassembled. The two chamber modules 101 have been separated so that the sealing interface can be seen. The plurality of bolt assemblies 121 are shown removed from their corresponding slots. A sealing plate 123 is disposed between the two chamber modules. The sealing plate 123 has mounted therein a resilient sealing member 124, e.g., an o-ring of rubber or other suitable material. When the two chamber modules are brought together, the sealing plate positions the resilient sealing member such that it engages tapered surfaces 125 of the chamber modules. As the bolt assemblies are tightened, the resilient sealing member is compressed in the space between each chamber module and the sealing plate, facilitating an air-tight seal.

Note that the tapered surfaces are protected from scratches in normal handling and storage of the chamber modules and the sealing plate, since the larger flat planes of the modules and plate will rest on any work surface, while the tapered sealing surface is angled away from possible damage. Also, the resilient sealing member is similarly protected, since it will be held away from potentially damaging interactions by its mounting in the tapered edge of the sealing plate.

Figure 4:
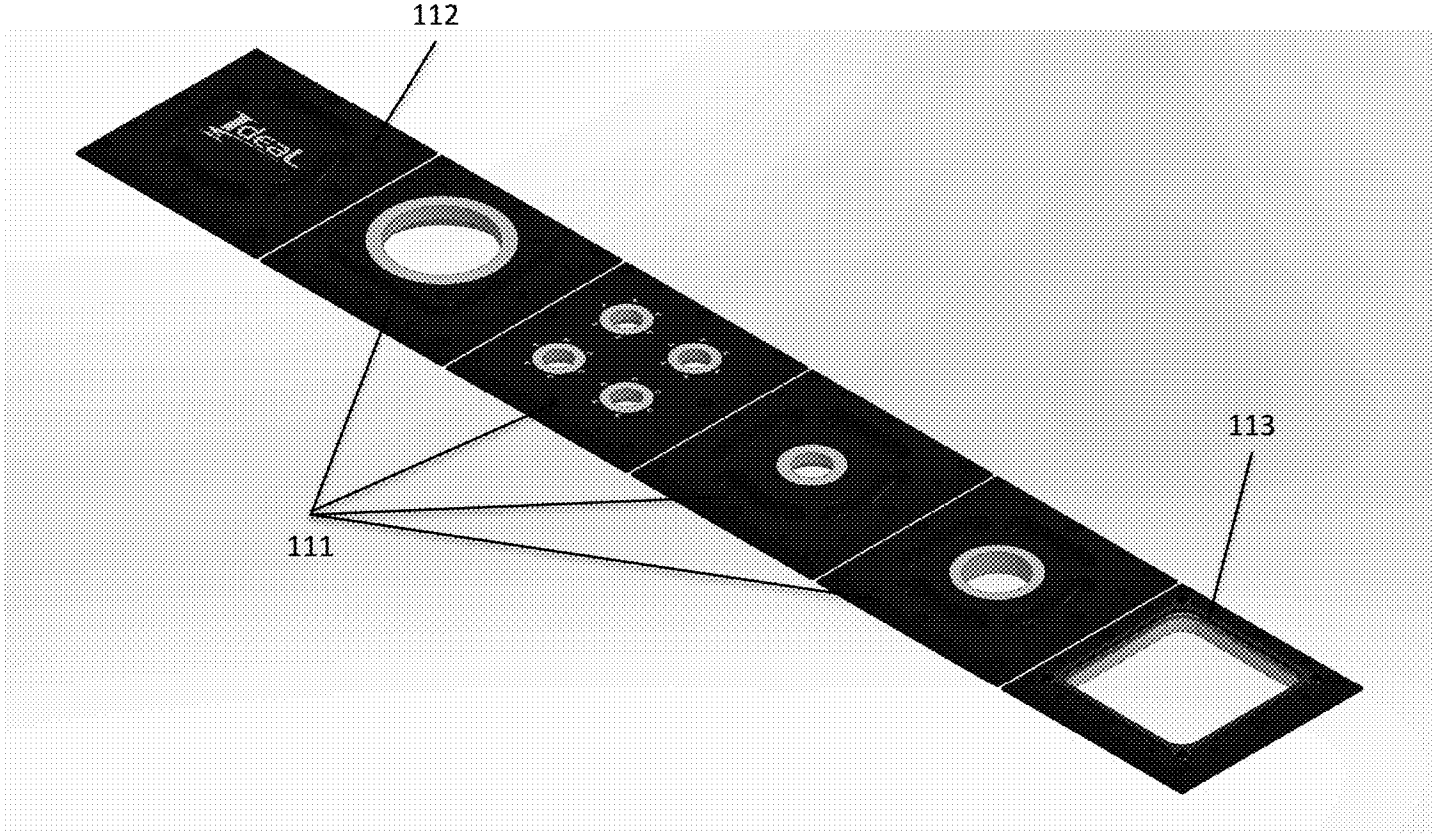
FIG. 4 is a schematic illustration of a plurality of wall plate modules according to the present invention.

FIG. 4 is a schematic illustration of a plurality of wall plate modules according to the present invention. Plate 112 provides a solid surface, sealing air and light from the chamber. Plates 111 provide an air seal and provide for one or more ports for communicating between the chamber and the surroundings. Plate 113 provides a solid plate, having an optically transparent window for sealing the chamber while allowing optical communication, e.g., for viewing or for optical communication between the inside and outside of the chamber.

Figure 5:
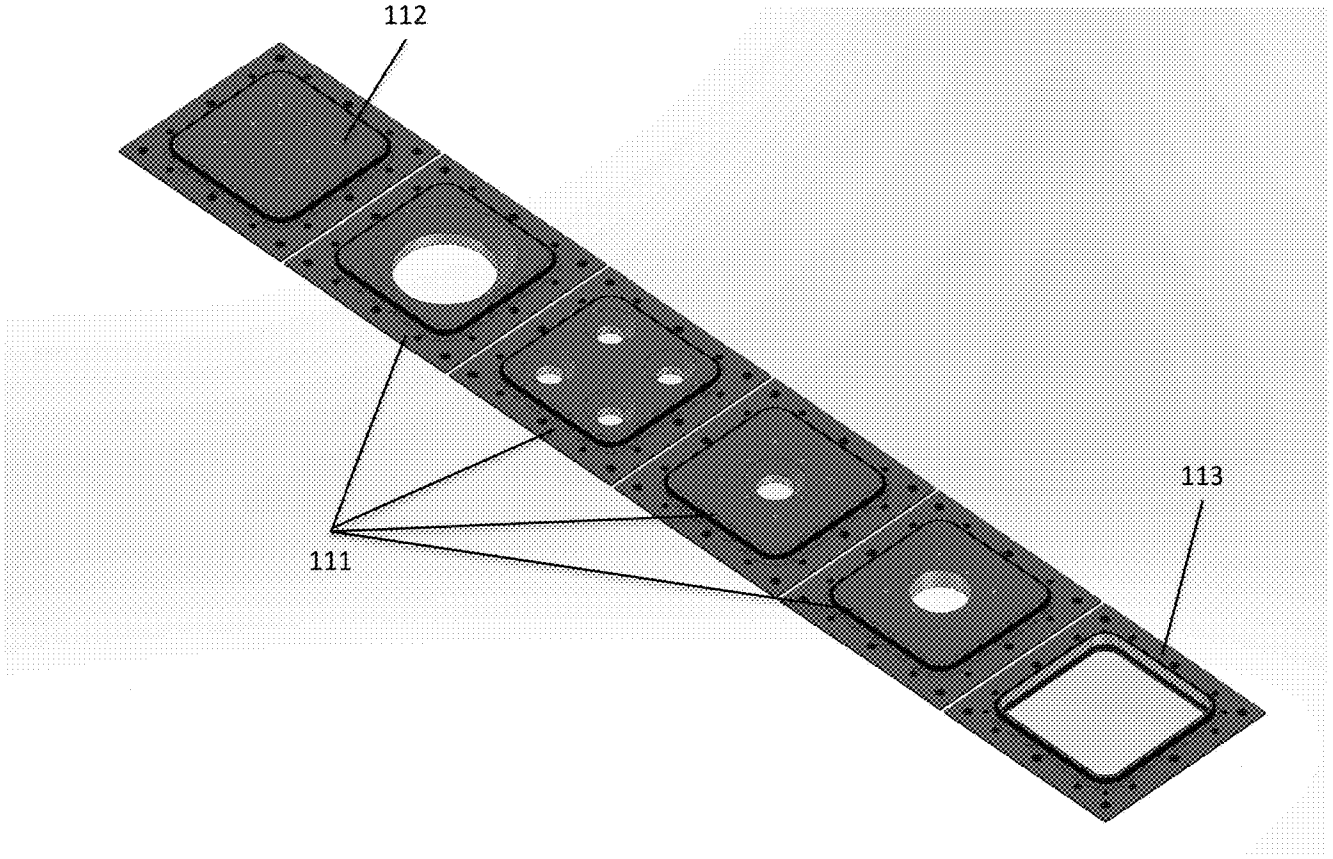
FIG. 5 is a schematic illustration of the reverse sides of the wall plate modules in FIG. 4.

FIG. 5 is a schematic illustration of the reverse sides of the wall plate modules in FIG. 4. Each plate has a raised portion that provides the tapered surface and holding features for a resilient sealing member as described with the sealing plates previously. Note that the tapered surface and resilient member will be protected from unwanted contact with other surfaces when the plates are handled or stacked, since the tapered surface is unlikely to engage any work surface or other material stacked on or under the plate module.

Figure 6:
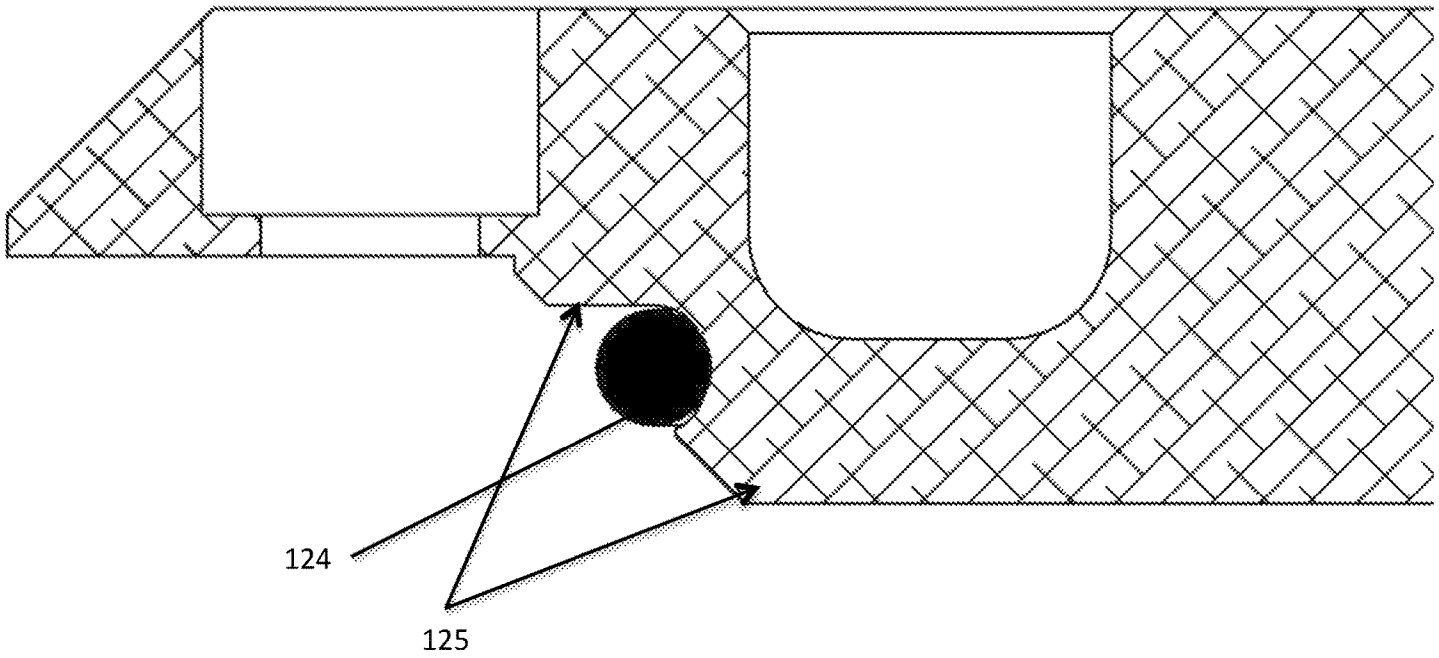
FIG. 6 is a schematic illustration of a cross-sectional view of a sealing feature of a vacuum chamber module according to the present invention.

FIG. 6 is a schematic illustration of a cross-sectional view of a sealing feature of a vacuum chamber module according to the present invention. A portion of a wall plate module is shown. The plate defines a tapered surface 125, angled (e.g., 45 degrees) relative to the upper and lower surfaces of the wall plate module. The tapered surface defines a channel that accommodates a resilient sealing member 124, holding the resilient sealing member in place for assembly and protecting it from unwanted contact with surface that may be in contact with the upper or lower surfaces of the wall plate, e.g., work surfaces, tools, or other modules stacked.

Figure 7:
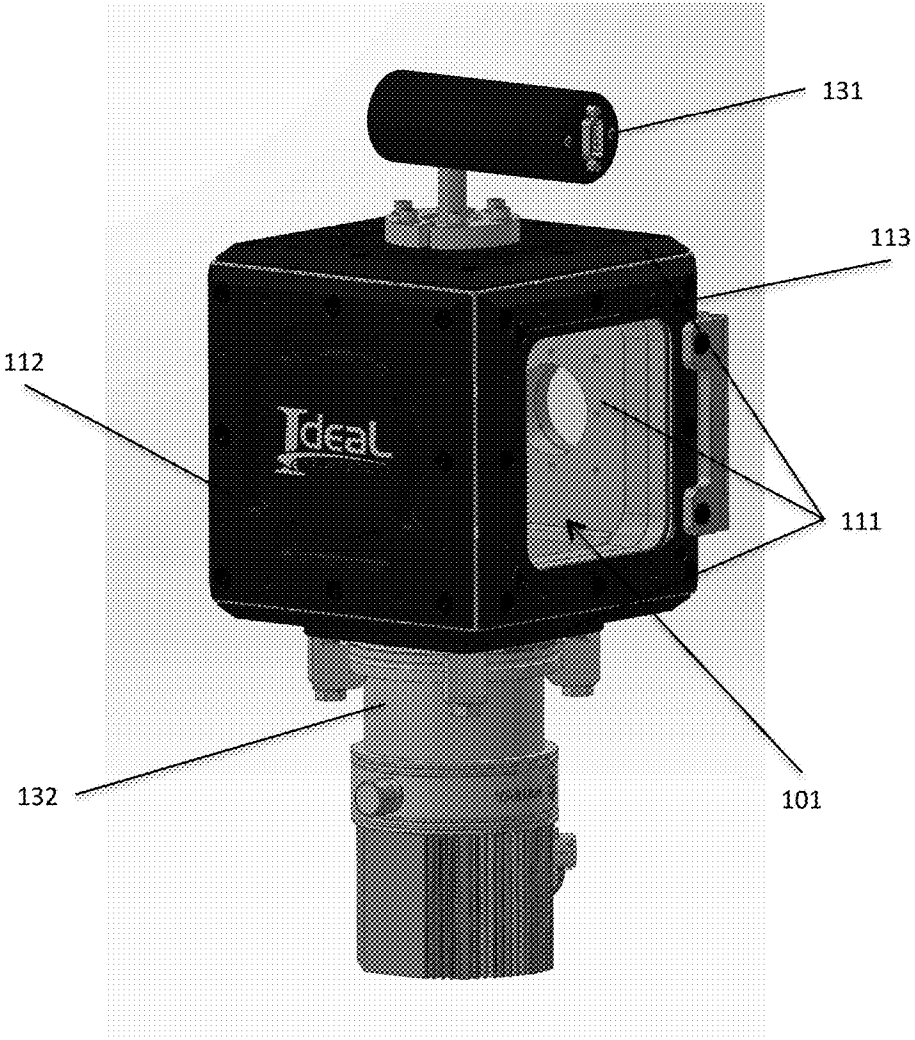
FIG. 7 is a schematic illustration of a vacuum chamber system according to the present invention.

FIG. 7 is a schematic illustration of a vacuum chamber system according to the present invention. The system comprises several of the elements described earlier. A single cube-shaped chamber module 101 is sealed on four sides by wall plate modules: a solid wall plate 112, an optically transparent wall plate 113, three wall plates with ports 111, and one wall plate not visible in the figure. The top wall plate port is used to provide connection with a data communication system 131. The bottom wall plate port is used to provide connection with a vacuum pump 132. As examples, connections with standard optical table mounting systems can be provided. All the wall plates are sealingly connected with the chamber module using tapered surfaces and resilient members as described before.

Figure 8:
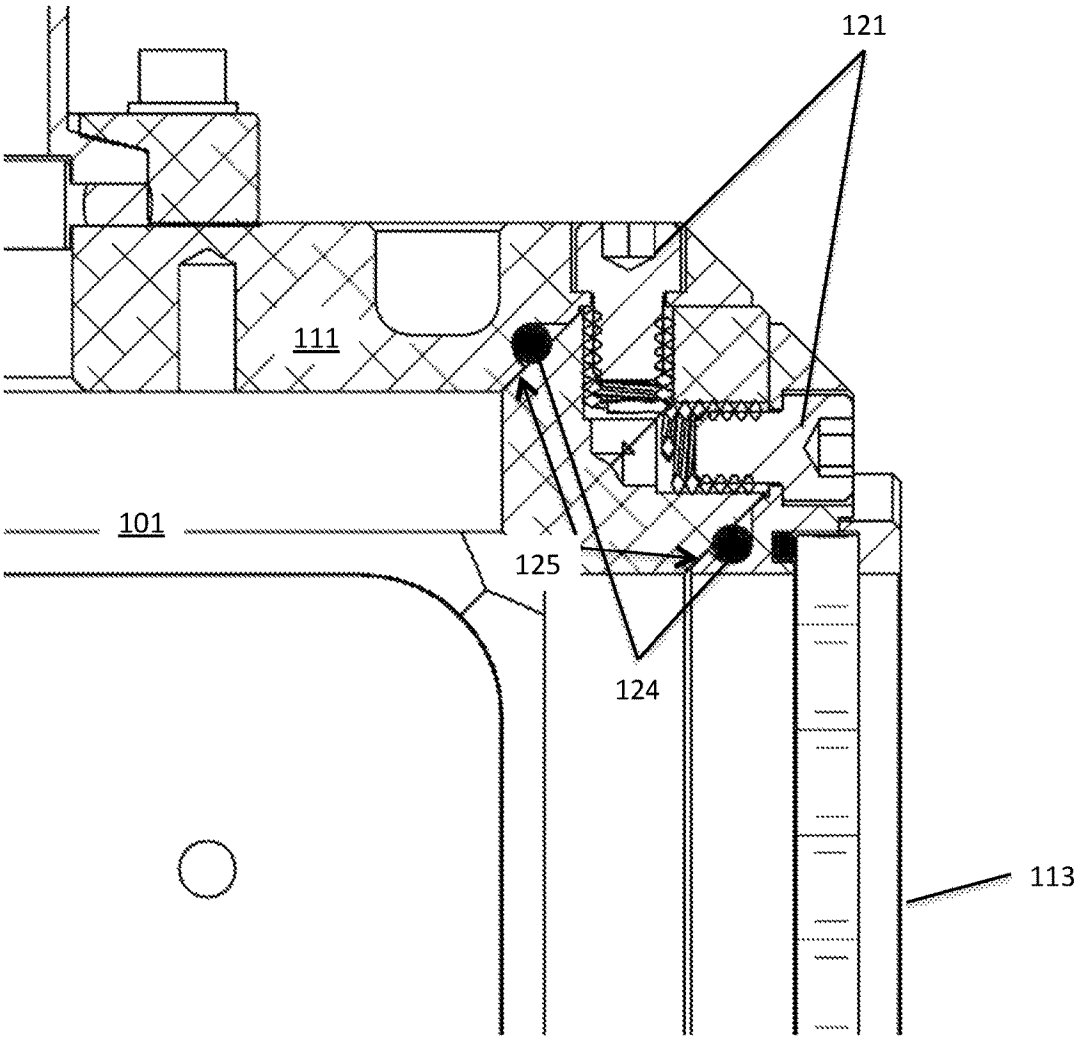
FIG. 8 is a schematic illustration of a cross sectional view of a vacuum chamber module and two plate modules according to the present invention.

FIG. 8 is a schematic illustration of a cross sectional view of portions of a vacuum chamber module and two plate modules according to the present invention. A cube-shaped chamber module 101 mounts with two wall plates 111, 113. The chamber module and wall plates have matching surfaces 125, angled from the planes of the faces of the chamber module and angled from the primary planes of the wall plate modules when mounted with the chamber module. Resilient sealing members 124 mount with the chamber module or the wall plate module prior to mounting the two together. When the wall plate module and the chamber module are brought together, the resilient sealing member is captured between the matching surfaces 125. Mounting features such as bolt assemblies 121 force the wall plates and chamber module together such that the resilient sealing member provides a vacuum-tight seal.

Figure 9:
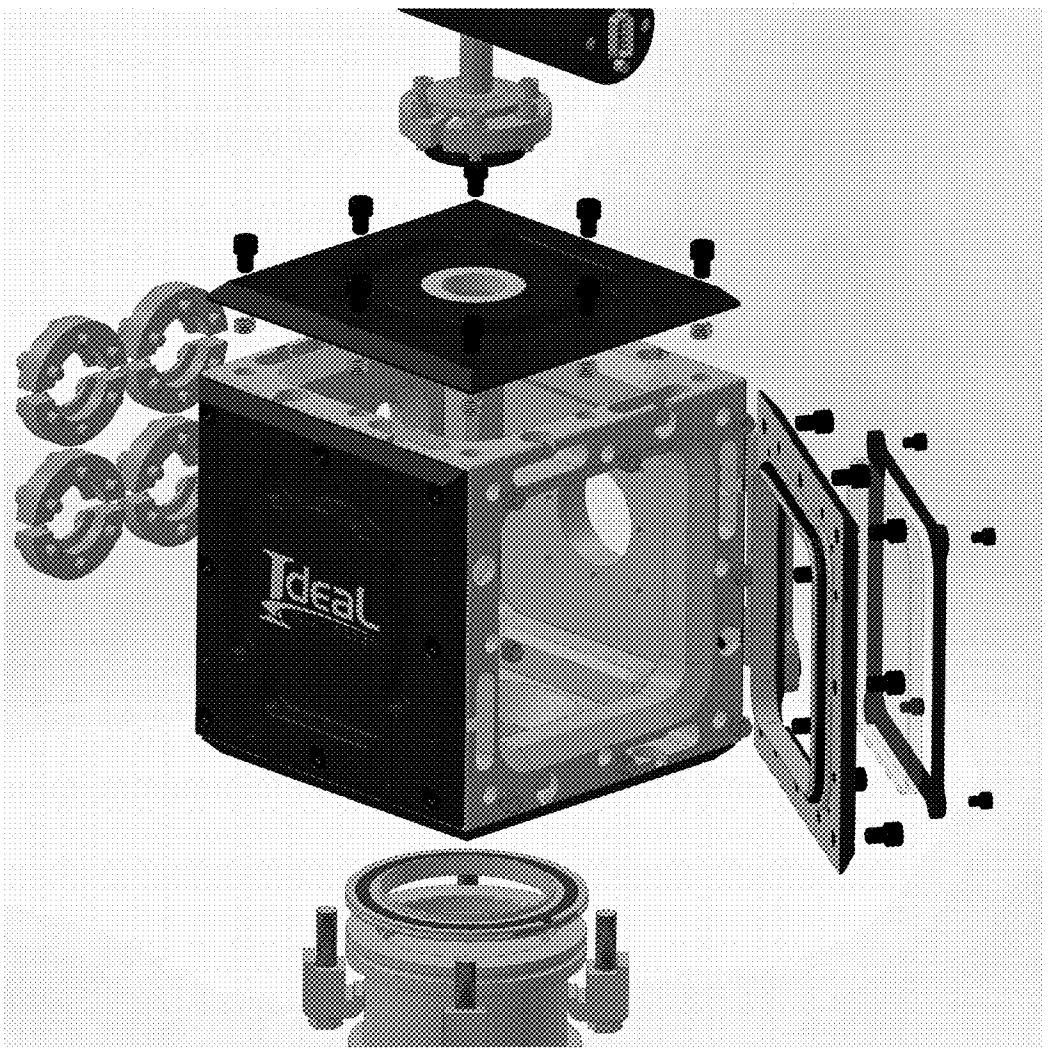
FIG. 9 is a schematic illustration of a vacuum chamber system as in FIG. 7, partially disassembled.

FIG. 9 is a schematic illustration of a vacuum chamber system as in FIG. 7, partially disassembled. A hinge assembly attached to the front wall plate module allows this module to function as a door when unbolted from the chamber module.

Figure 10:
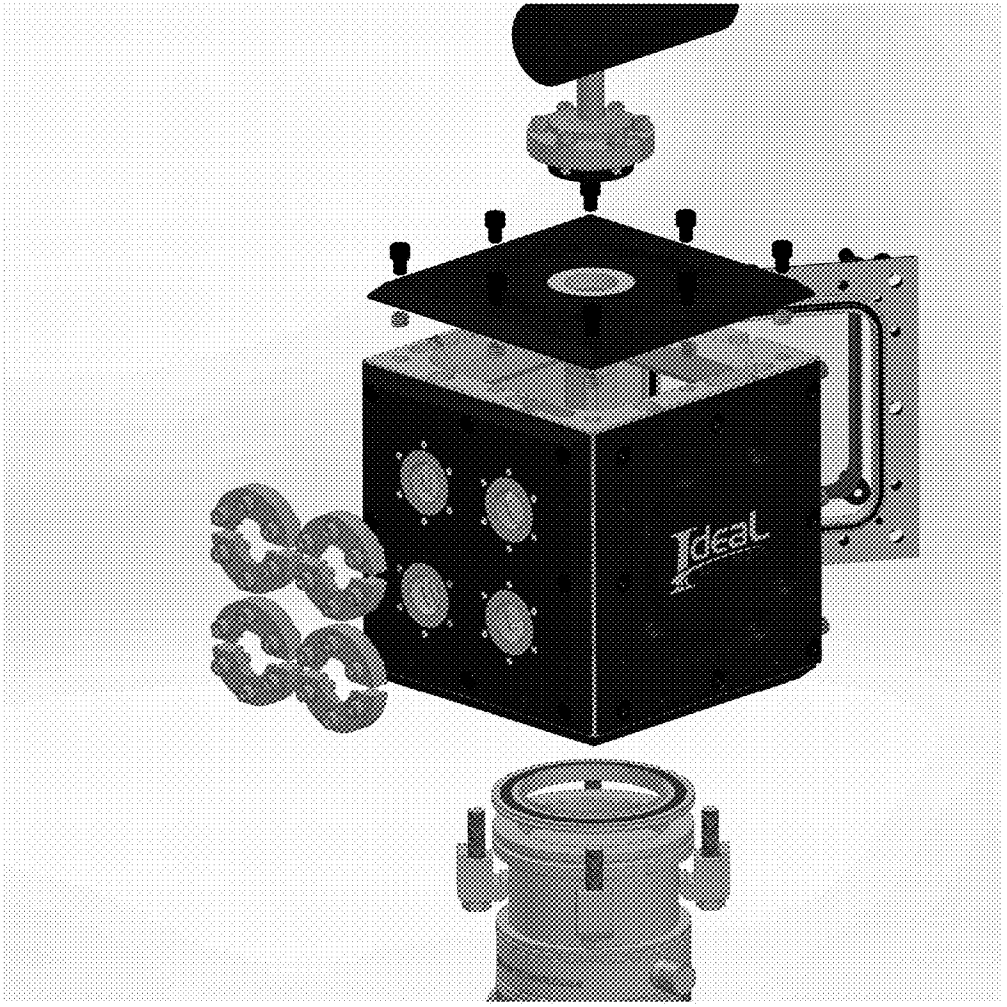
FIG. 10 is a schematic illustration of a vacuum chamber system as in FIG. 7, partially disassembled.

FIG. 10 is a schematic illustration of a vacuum chamber system as in FIG. 7, partially disassembled. Blind tapped holes in the wall modules can allow various connection types and sizes to be made to the chamber.

Figure 11:
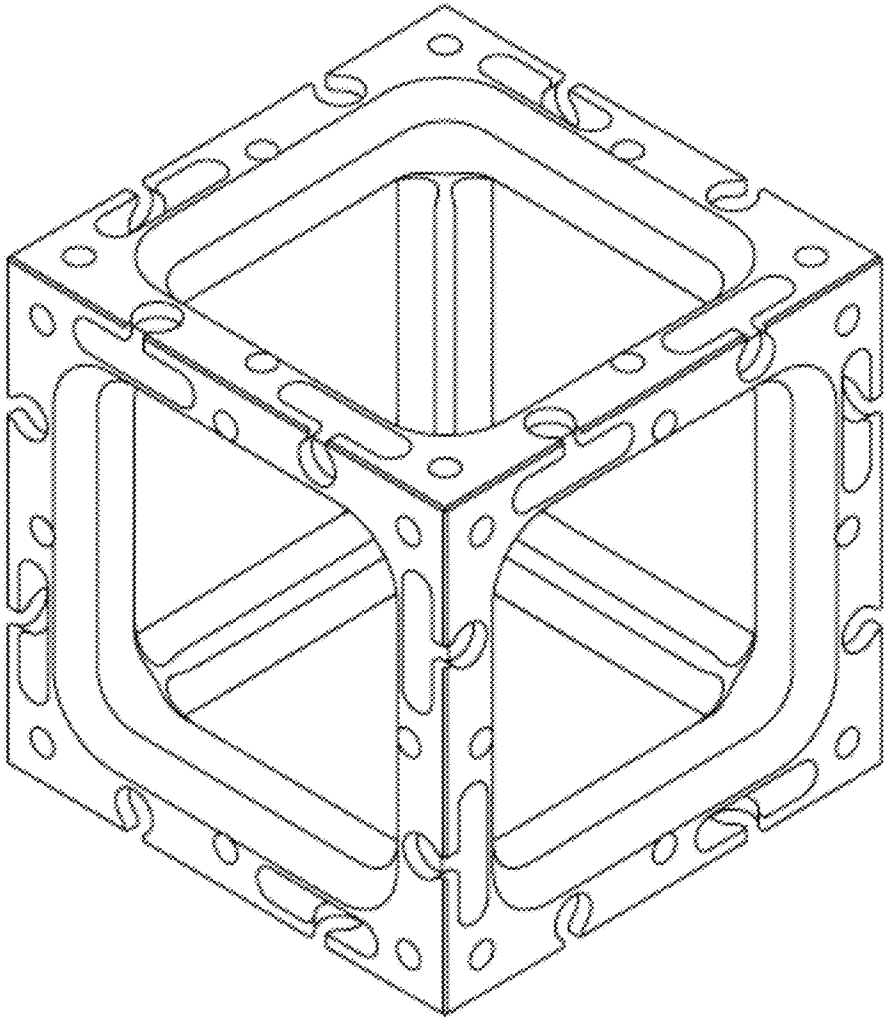
FIG. 11 is a schematic illustration of a vacuum chamber module according to the present invention.

FIG. 11 is a schematic illustration of a vacuum chamber module according to the present invention. Threaded mounting holes can further be reinforced with helical inserts to facilitate strong, repeatable fastening.

Figure 12:
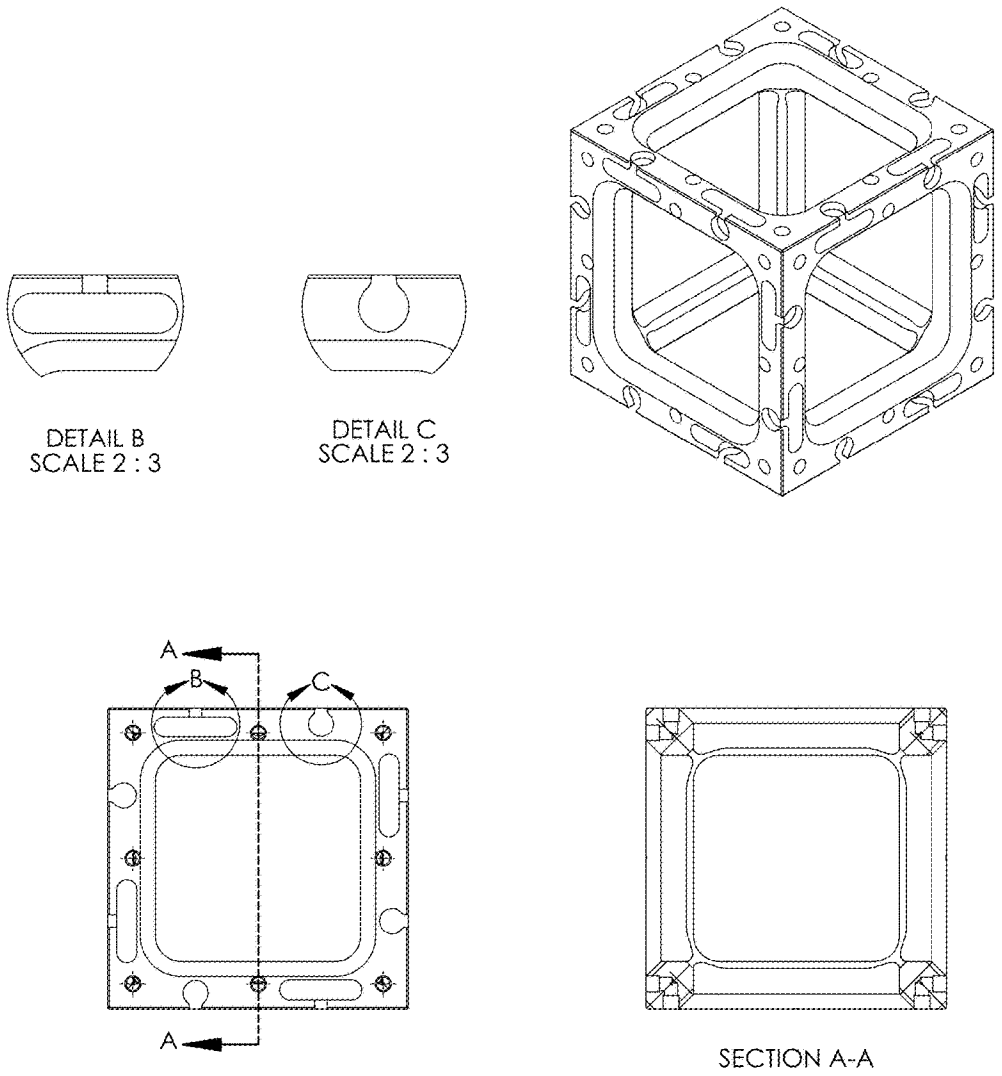
FIG. 12 comprises schematic illustrations of a chamber module having a roughly cubic shape, with details showing mounting features configured to accept compressive fasteners such as threaded fasteners to mount wall plates or other chamber modules.

FIGS. 12-21 comprise schematic illustrations of additional example embodiments and aspects of the present invention. FIG. 12 comprises schematic illustrations of a chamber module having a roughly cubic shape, with details showing mounting features configured to accept compressive fasteners such as threaded fasteners to mount wall plates or other chamber modules.

Figure 13:
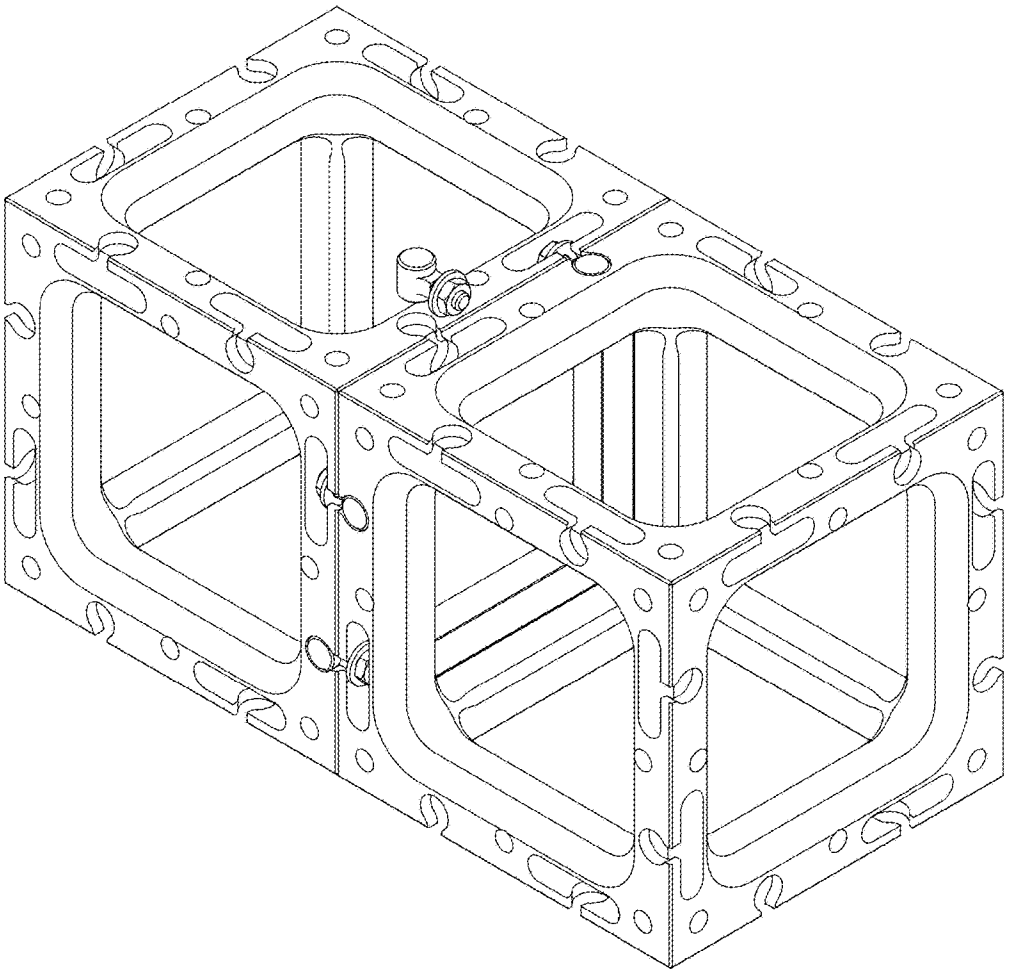
FIG. 13 comprises a schematic illustration of two chamber modules with fastening elements, three already in place and one positioned above its corresponding mounting feature.

FIG. 13 comprises a schematic illustration of two chamber modules with fastening elements, three already in place and one positioned above its corresponding mounting feature.

Figure 14:
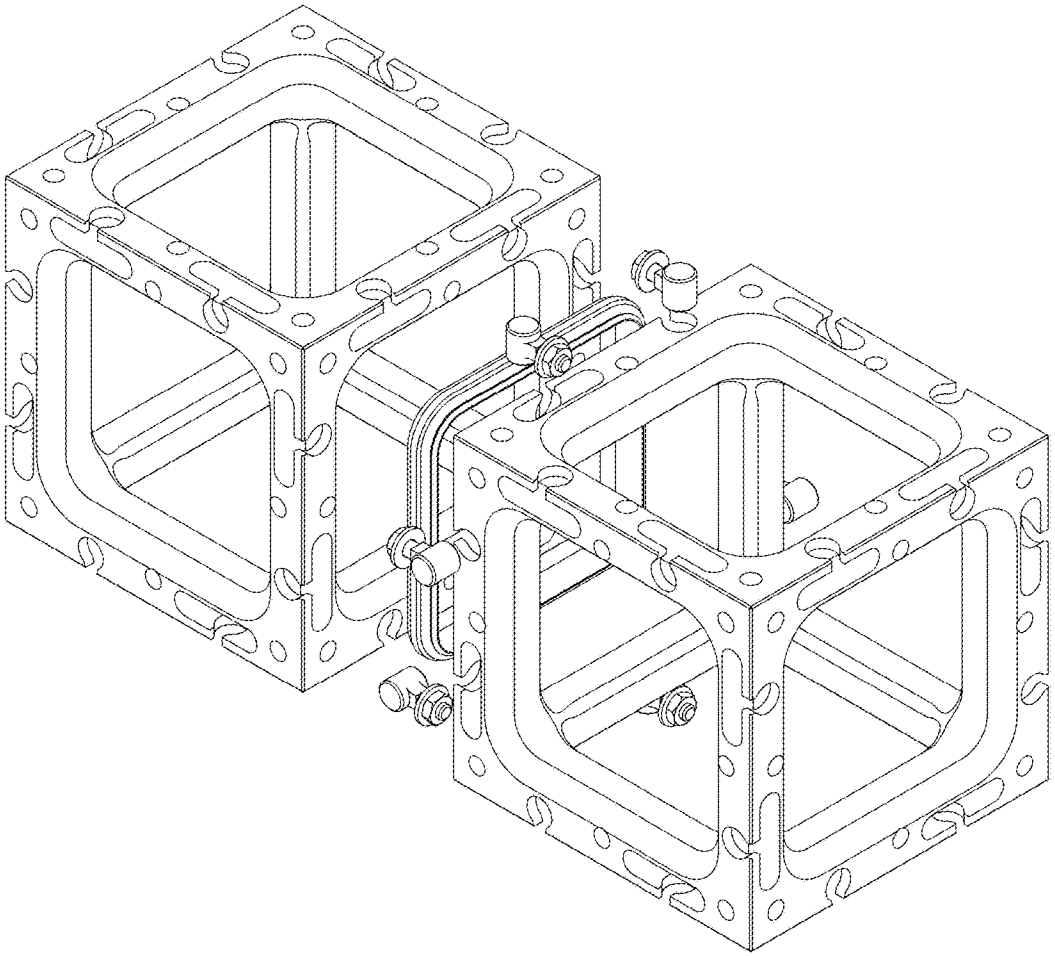
FIG. 14 comprises a schematic illustration of the two chamber embodiment from FIG. 13 disassembled.

FIG. 14 comprises a schematic illustration of the two chamber embodiment from FIG. 13 disassembled. A sealing plate include resilient sealing members, one visible facing the chamber in the lower right of the figure and one not visible, but facing the chamber in the upper left of the figure. The sealing plate and the chamber modules have matching tapered surfaces as described with previous figures.

Figure 15:
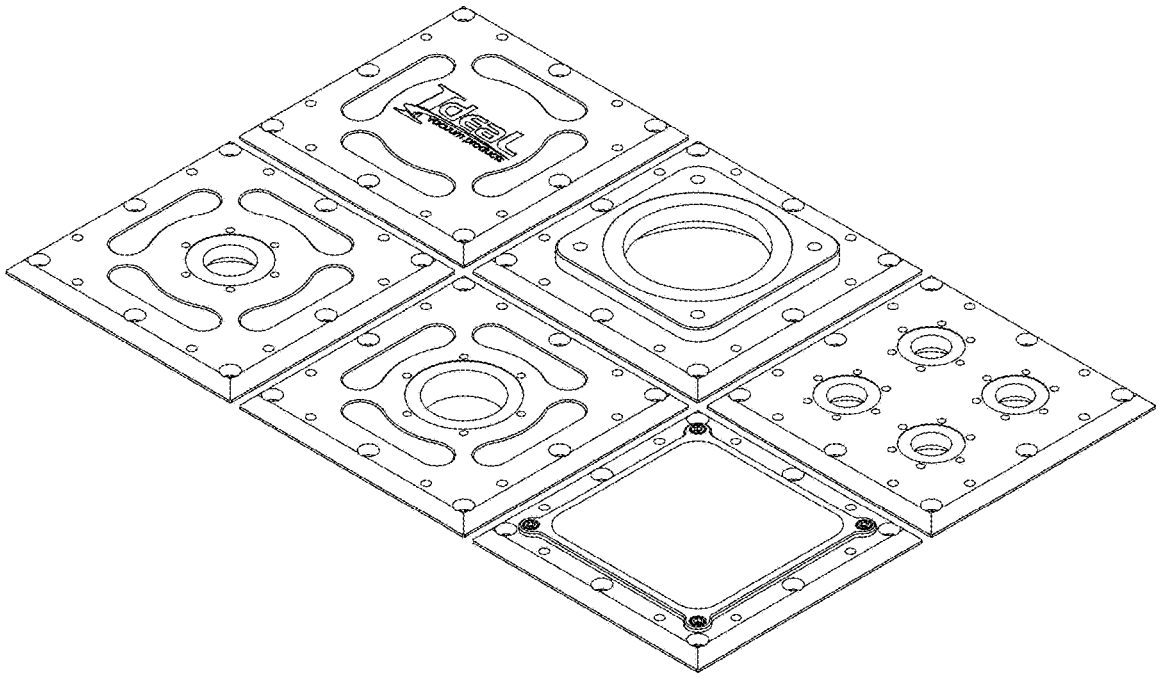
FIG. 15 comprises schematic illustrations of wall plates similar to those described in connection with FIG. 4.
Figure 16:
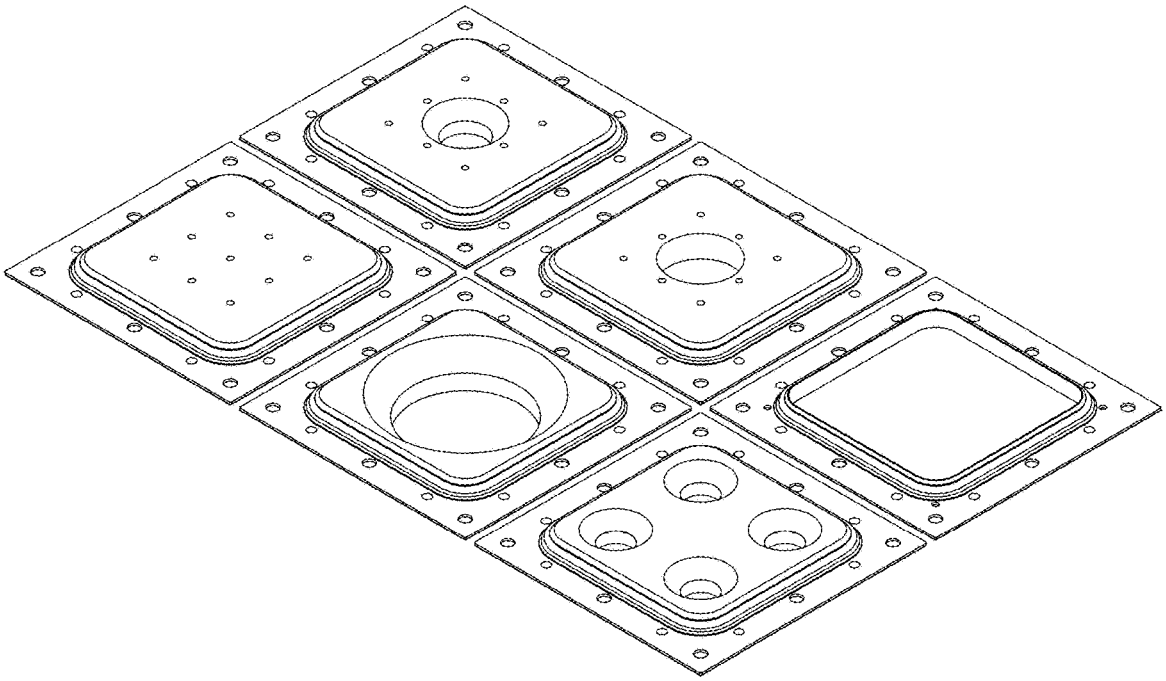
FIG. 16 comprises schematic illustrations of the reverse sides of wall plates as in FIG. 15.

FIG. 15 comprises schematic illustrations of wall plates similar to those described in connection with FIG. 4. FIG. 16 comprises schematic illustrations of the reverse sides of wall plates as in FIG. 15, showing the tapered surfaces configured to accept a resilient sealing member and match a chamber module tapered surface.

Figure 17:
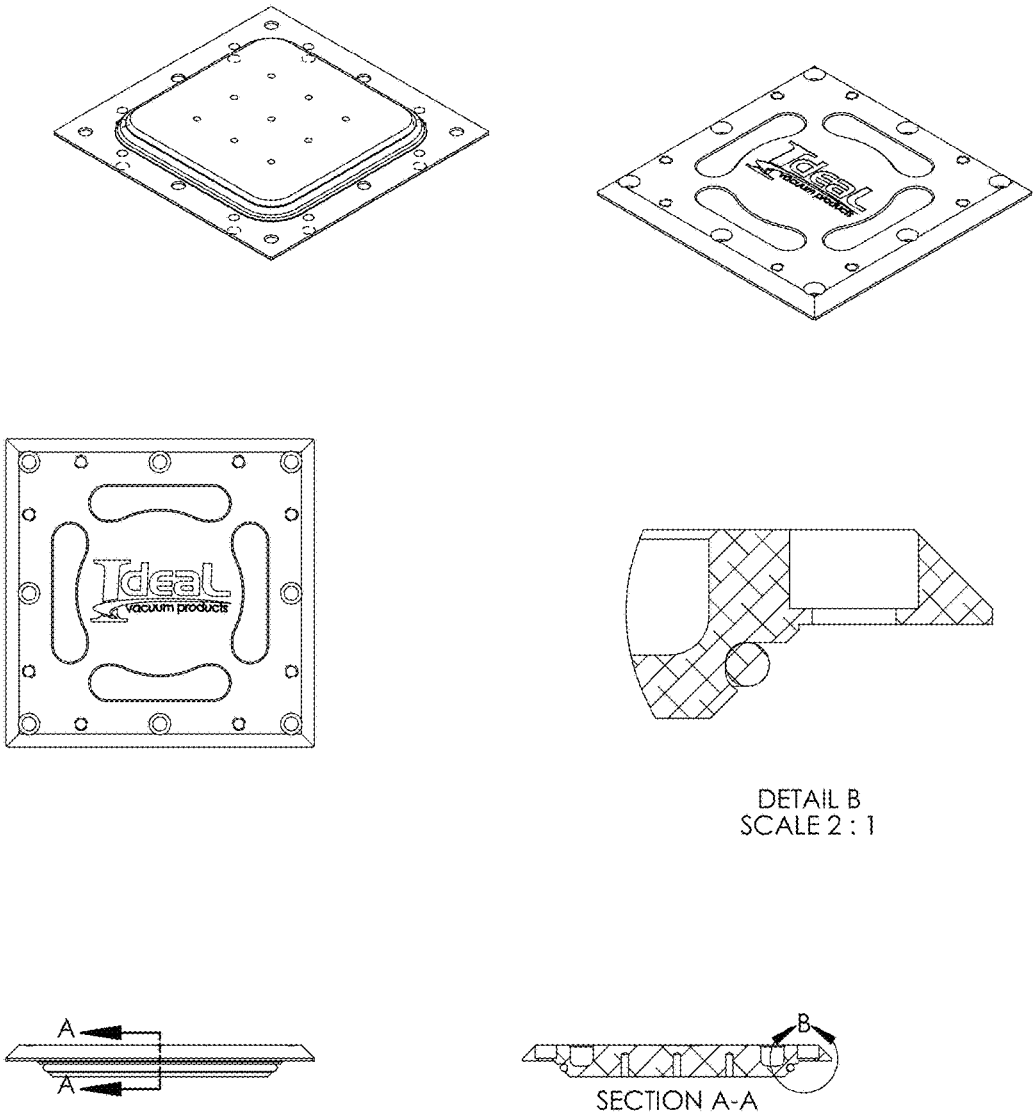
FIG. 17 comprises schematic illustrations of several wall plates, including detailed views of the tapered surface with resilient sealing element mounted therewith.

FIG. 17 comprises schematic illustrations of several wall plates, including detailed views of the tapered surface with resilient sealing element mounted therewith.

FIG. 18 comprises schematic illustrations of an assembled vacuum chamber according to the present invention. A section through the chamber, shown at the lower right of the figure, allows the relative positioning of the chamber, the wall plates, the tapered surfaces, and the resilient sealing element to be seen.

Figure 19:
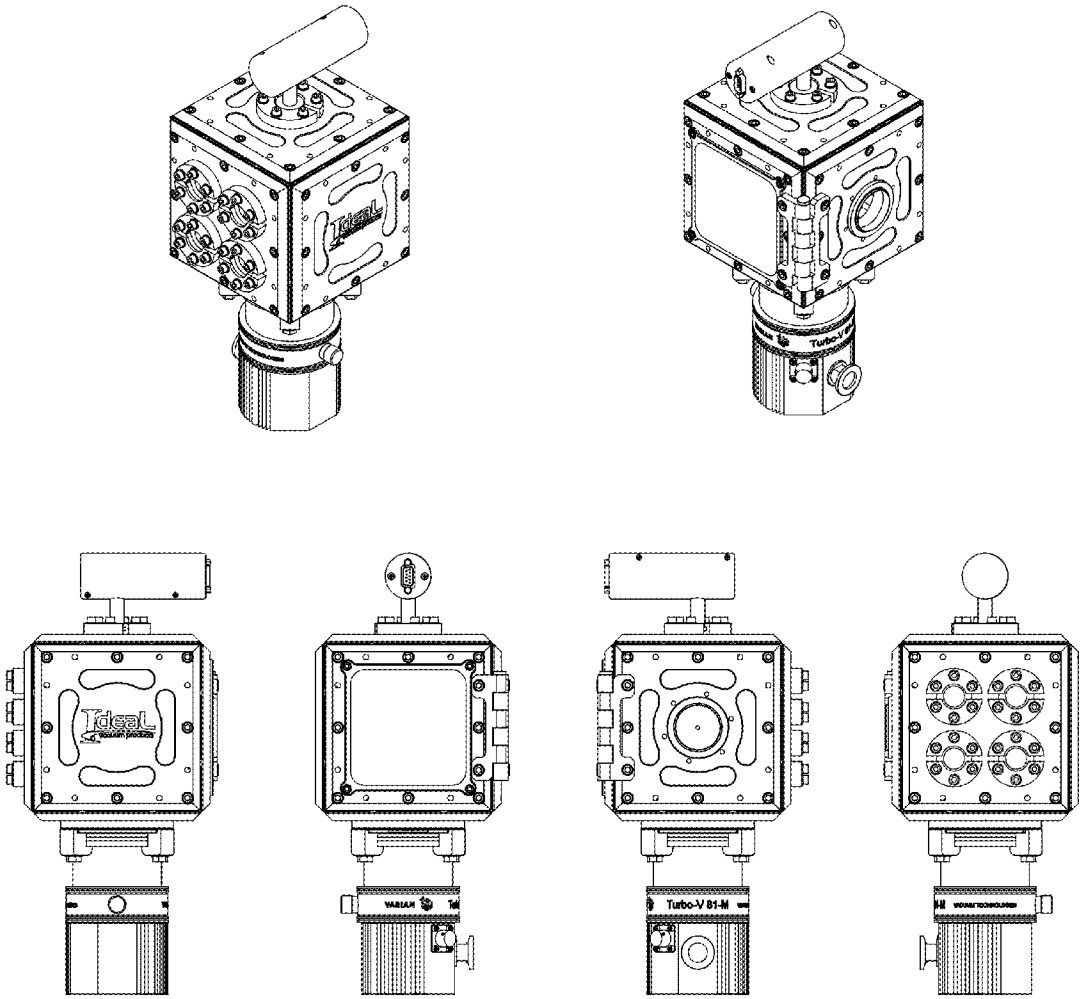
FIG. 19 comprises schematic illustrations of an assembled vacuum chamber according to the present invention.

FIG. 19 comprises schematic illustrations of an assembled vacuum chamber according to the present invention. The assembled chamber includes a wall plate on the bottom of the assembled chamber that accommodates mounting with a support. A wall plate on the top of the assembled chamber accommodates electrical connections. One wall plate is hinged to facilitate easy access to the interior of the chamber.

Figure 20:
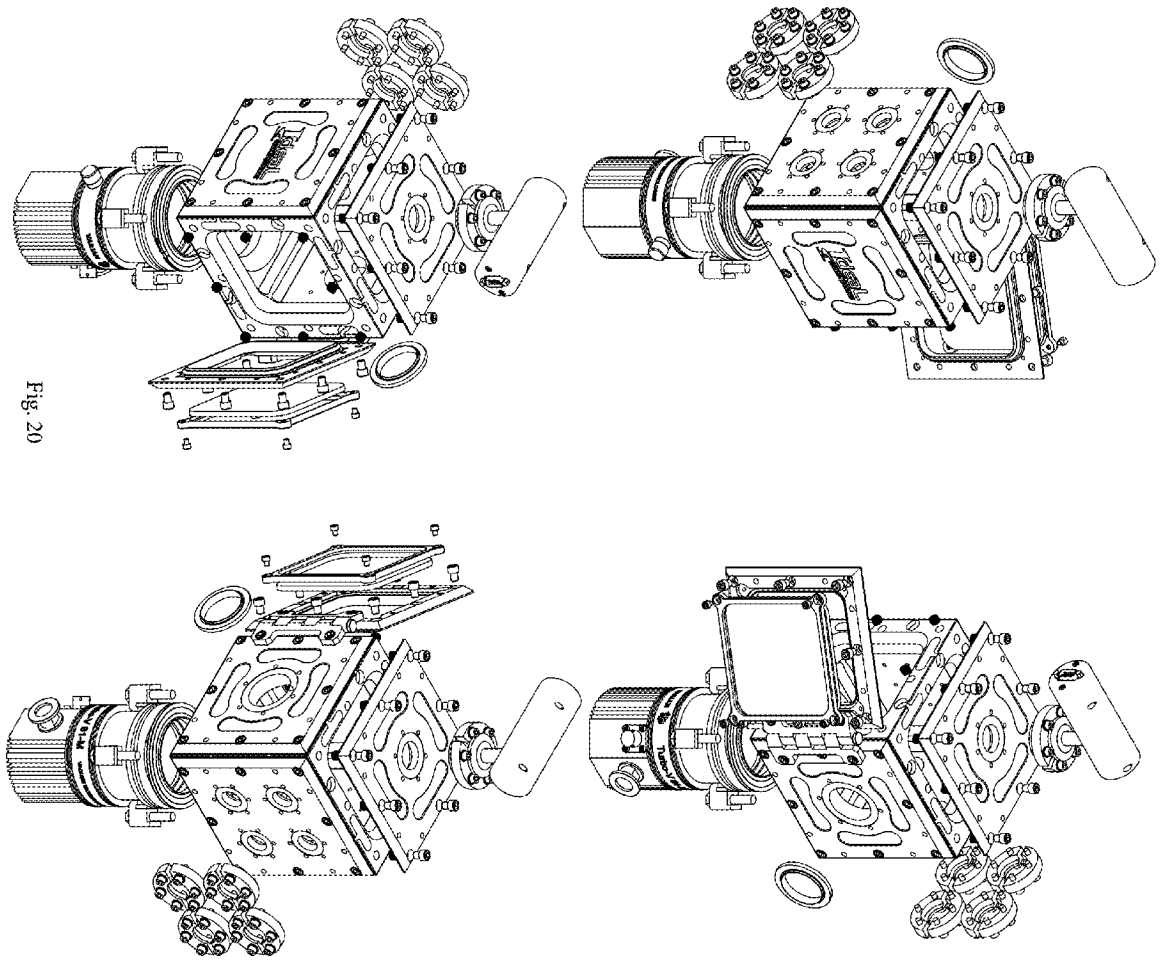
FIG. 20 comprises schematic illustrations of a vacuum chamber as in FIG. 19, with the parts disassembled to allow visualization of the various individual parts.

FIG. 20 comprises schematic illustrations of a vacuum chamber as in FIG. 19, with the parts disassembled to allow visualization of the various individual parts.

Figure 21:
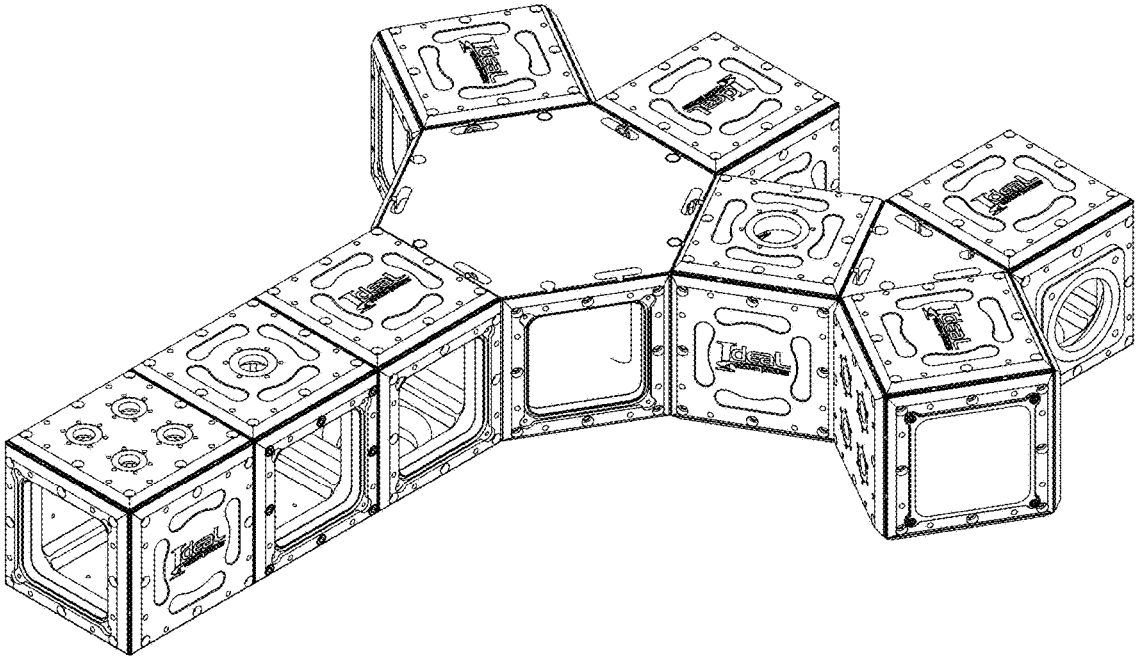
FIG. 21 is a schematic illustration of an assembled vacuum chamber system according to the present invention.

FIG. 21 is a schematic illustration of an assembled vacuum chamber system according to the present invention. The chamber comprises 8 cubic chamber modules. A hexagonal chamber module has mounting and sealing features like those described previously. Two sides of the hexagonal chamber module are closed with wall plates. Four sides are joined with cubic chambers. A triangular chamber module is also provided, with mounting and sealing features like those described previously. The three sides of the triangular chamber module are joined with cubic chambers. Various wall plates are used to close the sides of the cubic chamber modules, facilitating visual inspection and electrical communication with operations inside the vacuum. The chamber system shown in the figure illustrates the flexibility afforded by the present invention—the same repeatable sealing approach can be used to join multiple different chamber modules and wall plates to yield vacuum chamber systems tailored for specific applications.

Figure 22:
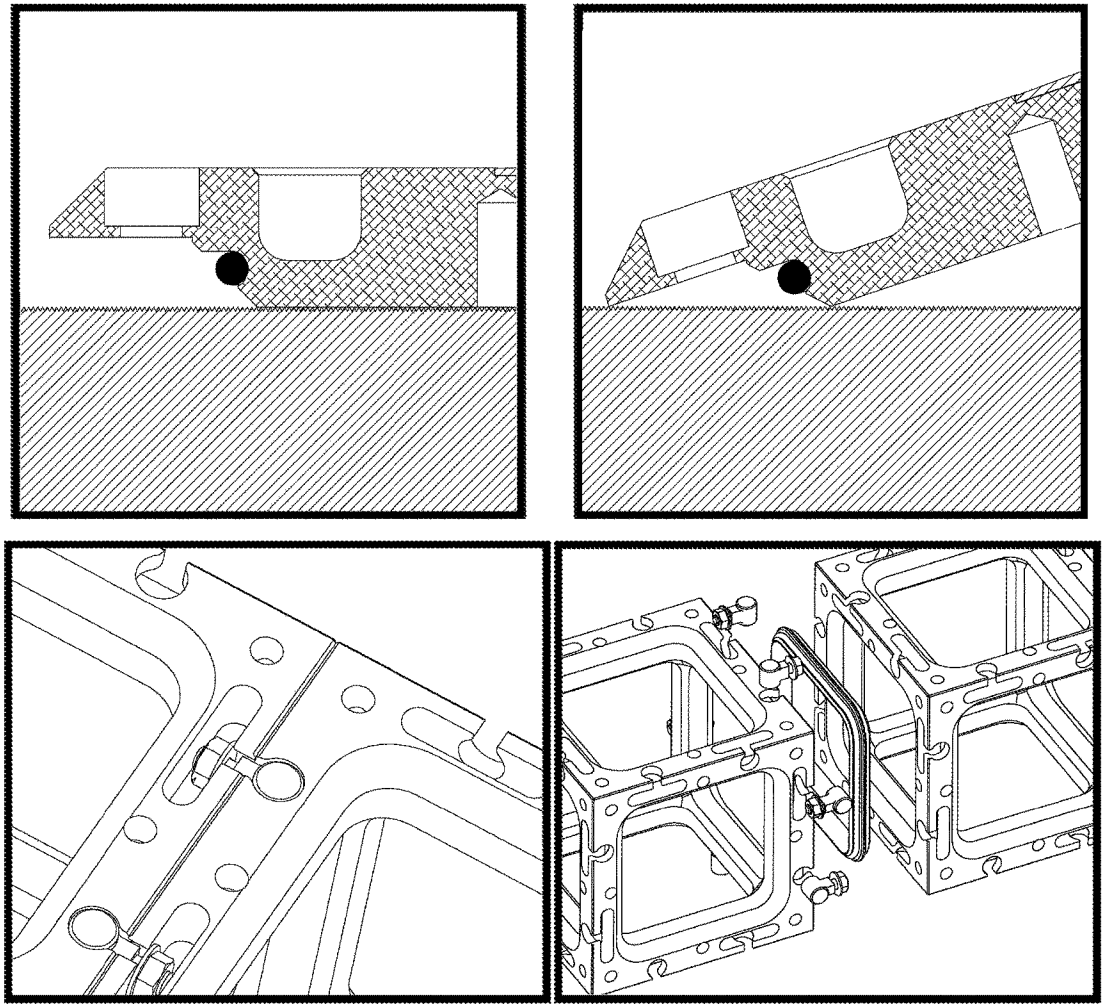
FIG. 22 is a schematic illustration of an example embodiment of the present invention.

FIG. 22 is a schematic illustration of an example embodiment of the present invention. The green shaded portion of the views corresponds to a tapered sealing surface, or region proximal thereto. In assembling a vacuum chamber, it can be important that the sealing surfaces remain undamaged by contact with things that can scratch or deform the surface. Scratches, dents, or other damage can reduce the likelihood that the assembled elements will provide the desired seal. Also, achieving the desired seal can involve the use of resilient sealing members; contact with hard surfaces or edges can damage those members and reduce the likelihood that the desired seal will be obtained. As can be seen in the image at the top left of the figure, the tapered portion of the example embodiment prevents the sealing surface and the resilient sealing member from contacting a surface on which the large flat side of the chamber module or wall plate is placed. This is in contrast to existing vacuum chamber designs, where the sealing surfaces and resilient elements must be specially protected when handling modules and plates, since they will otherwise come in direct contact with surfaces on which the modules or plates are placed.

The tapered surface of the present invention also provides inherent protection as the module or plate is handled, as can be seen in the upper right image of the figure. As a module or plate is lifted from or lowered onto a surface, it can easily be tilted from a purely horizontal orientation. With modules and plates having that have a region that overlaps, or extends beyond, the tapered surface, the sealing surface and resilient element are still prevented from damaging contact even when the module or plate is tilted in handling.

The placement of the tapered surface inside the outer boundary of the module or plate, as seen in the image at the lower left of the figure, provides protection as the vacuum chamber is assembled, since fasteners can be located and installed away from the sealing surface.

This configuration also provides additional protection as the modules and plates are assembled, as seen in the image at the lower right of the figure. As an example, a cuboid module provides a stable surface defined by the outer surface of the module. When the module is placed on a work surface during handling, storage, or assembly, the tapered sealing surface is held away from the work surface and thus protected from damage. As additional modules are attached, the stable surface grows in extend and can make it even less likely that a work surface will damage the sealing surface or resilient element mounted therewith.

Chamber modules and wall plate modules of the system can be fabricated with any material compatible with the strength requirements, for example 6061-T6 aluminum can be suitable, because of its reasonable cost, easy machinability, and desirable outgassing properties when used in vacuum. Helical inserts can be installed into machine tapped threads in the chamber modules and serve to increase the durability of those threads during repeated use of bolt fasteners. The bolts used in the assembly can be of stainless steel, although selection of material and grade can vary depending on specific cost and performance requirements. Resilient sealing members can comprise O-rings, which can comprise any range of materials suitable for vacuum, including nitrile rubber, fluorocarbon, silicone, fluorosilicone, perflourinated elastomer, etc. Window components can be fabricated with glass, although the particular selection of window material is not necessarily critical to the design for some applications.

Chamber modules and wall plate modules can be machined from billet metal. Other manufacturing techniques which are capable of creating accurate geometry with material properties acceptable for use in vacuum can also be acceptable, such as casting, 3D printing, and other techniques known to those skilled in the art. Individual modules can be coated or otherwise treated on the exterior for aesthetic purposes and surface protection. Coating of surfaces interior to the chamber can increase outgassing and degrade performance of the system, so it can be undesirable in some applications. Assembly of the system is readily apparent to those of skill in the art. Traditional preparation techniques such as baking or interior surface cleaning processes can be used in order to improve performance of the system. Vacuum grease can be optionally used in order to increase the performance of o-ring or other seals used in the system. Fastener torque specifications do not differ from typical values used in other applications.

Due to its elastomer seals, this system can easily be pumped down to "high vacuum" (i.e. $1\times10^{-7}$ torr) levels. The use of commonly available vacuum equipment such as turbo pumps, ion pumps, cryo pumps, or other high-vacuum pumps can be used, possibly in conjunction with heaters, cold traps or other tools in order to achieve even lower pressures. The ultimate vacuum limitations of this system are primarily affected by outgassing from elastomer seals and the chamber's internal walls. Other shapes (e.g., spherical chamber modules, round wall plates) can be suitable. The desired sealing interfaces can be provided as shown, and can be provided with matching, reversed tapers on chamber modules and wall plate modules, although such configurations can limit the flexibility of assembly and variety of completed systems that can be realized. The shapes of chamber modules can differ from the basic cubic design shown in the figures. Wall plates that are not square or rectangular can also be used with similar tapered seal design and similar bolted connections.

The present invention has been described in connection with various example embodiments. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A vacuum chamber system, comprising: (a) a chamber module, defining an interior volume and having an outer chamber surface facing away from the inner volume and having at least one opening defining a first shape, wherein the opening has a continuous surface about the perimeter of the first shape that is tapered relative to the outer chamber adjacent to the opening such that the perimeter of the opening decreases with increasing depth from the outer chamber surface toward the inner volume; (b) a wall plate module, configured to sealingly engage the chamber module using a surface having a sealing shape matching the first opening shape and having a surface tapered to match the taper of the chamber module opening, wherein the wall plate module further comprises an overlap portion that extends outward from the sealing shape beyond the wall plate module's tapered surface wherein the tapered surface of the wall plate module is configured to retain a resilient sealing member such that, when the wall plate module engages the chamber module, the resilient sealing member seals against only non-resilient surfaces.

2. A vacuum chamber system as in claim 1, further comprising a mounting facility, configured to secure the wall plate module to the chamber module applying force only orthogonal to the opening.

3. A vacuum chamber system as in claim 1, wherein the chamber module defines a substantially cuboid shape.

4. A vacuum chamber system as in claim 1, further comprising a second chamber module having at least one opening defining a second shape, wherein the opening has a surface tapered relative to surfaces of the second chamber module adjacent to the opening; (b) a connector module, configured to sealingly engage the first chamber module using a surface having a shape matching the first opening shape and having a surface tapered to match the taper of the first chamber module opening, and configured to sealingly engage the second chamber module using a surface having a shape matching the second opening shape and having a surface tapered to match the taper of the second chamber module opening.

5. A vacuum chamber system as in claim 4, wherein the first shape and the second shape are substantially the same.

6. A vacuum chamber system as in claim 1, wherein the resilient sealing member comprises an o-ring.

7. A vacuum chamber system, comprising: (a) a chamber module, defining an interior volume and having an outer chamber surface facing away from the inner volume and having at least one opening defining a first shape, wherein the opening has a continuous surface about the perimeter of the first shape that is tapered relative to the outer chamber adjacent to the opening such that the perimeter of the opening decreases with increasing depth from the outer chamber surface toward the inner volume; (b) a wall plate module, configured to sealingly engage the chamber module using a surface having a sealing shape matching the first opening shape and having a surface tapered to match the taper of the chamber module opening, wherein the wall plate module further comprises an overlap portion that extends outward from the sealing shape beyond the wall plate module's tapered surface;

further comprising a mounting facility, configured to secure the wall plate module to the chamber module applying force only orthogonal to the opening wherein the mounting facility comprises a plurality of threaded fasteners, each configured to engage recesses in the chamber module and in the wall plate module.

8. A vacuum chamber system as in claim 7, wherein at least one of the tapered surfaces of the chamber module opening and the wall plate module is configured to retain a continuous resilient sealing member, and wherein the mounting facility comprises a plurality of threaded fasteners, wherein the threaded fasteners are configured to compress the resilient sealing member as the threaded fasteners secure the wall plate module to the chamber module, and wherein the threaded fasteners are all outside the area defined by the resilient sealing member.

9. A vacuum chamber system, comprising: (a) a chamber module, defining an interior volume and having an outer chamber surface facing away from the inner volume and having at least one opening defining a first shape, wherein the opening has a continuous surface about the perimeter of the first shape that is tapered relative to the outer chamber adjacent to the opening such that the perimeter of the opening decreases with increasing depth from the outer chamber surface toward the inner volume; (b) a wall plate module, configured to sealingly engage the chamber module using a surface having a sealing shape matching the first opening shape and having a surface tapered to match the taper of the chamber module opening, wherein the wall plate module further comprises an overlap portion that extends outward from the sealing shape beyond the wall plate module's tapered surface wherein the chamber module has a first wall having a thickness and a substantially planar outer surface; and the opening comprises an opening in the first wall, wherein the opening is spaced at least a first distance from the outer edges of the substantially planar outer surface, and decreases in size with increasing depth into the first wall, wherein the decreasing size forms the tapered surface of the opening; and the wall plate module has a thickness and a substantially planar region corresponding to the portion of the substantially planar outer surface outside the opening, and a tapered surface matching the tapered surface of the opening.

10. A vacuum chamber module as in claim 9, wherein the wall plate module's tapered surface defines a continuous groove in such surface and extending around a perimeter of the sealing shape and further comprising a continuous resilient sealing member disposed in such groove.

11. A vacuum chamber module as in claim 10, wherein the groove defines a first perimeter of the sealing shape on one side of the groove, and a second perimeter of the sealing shape on the other side of the groove, where the first perimeter is greater than the second perimeter, and wherein the resilient sealing member has a first length when at rest, and a second length when subjected to a stretching force, and wherein the first length is less than the first perimeter, and wherein the second length is greater than the second perimeter.

12. A vacuum chamber system as in claim 9, wherein the tapered surface of the chamber module opening is configured to retain a continuous resilient sealing member.

13. A vacuum chamber system as in claim 12, wherein the resilient sealing member comprises an o-ring.

* * * * *